US005876254A

United States Patent [19]

Ulrich et al.

[11] Patent Number: 5,876,254

[45] Date of Patent: Mar. 2, 1999

[54] APPARATUS FOR SECURING CONTACTS IN A CONTACT HOUSING

[75] Inventors: Jörg-Jens Ulrich, Frankfurt/M.; Andreas Machill, Idstein, both of Germany

[73] Assignee: The Whitaker Corporation, Wilmington, Del.

[21] Appl. No.: 874,487

[22] Filed: Jun. 13, 1997

[30] Foreign Application Priority Data

Jun. 28, 1996 [DE] Germany ..... 196 26 079.5

[51] Int. Cl.[6] ..... H01R 13/434

[52] U.S. Cl. ..... 439/752

[58] Field of Search ..... 439/752, 157

[56] References Cited

U.S. PATENT DOCUMENTS

| | | | |
|---|---|---|---|
| 5,281,168 | 1/1994 | Krehbiel et al. | 439/752 |
| 5,489,224 | 2/1996 | Schwarz | 439/752 |

FOREIGN PATENT DOCUMENTS

| | | | |
|---|---|---|---|
| 0 363 804-A1 | 4/1990 | European Pat. Off. | H01R 13/629 |
| 0 655 799-A1 | 5/1995 | European Pat. Off. | H01R 13/436 |
| 39 10 117-C1 | 9/1990 | Germany | H01R 13/52 |
| WO 89/01247 | 2/1989 | WIPO | H01R 13/436 |

OTHER PUBLICATIONS

European Search Report

*Primary Examiner*—Gary Paumen
*Assistant Examiner*—Briggitte R. Hammond
*Attorney, Agent, or Firm*—Driscoll A. Nina

[57] ABSTRACT

An apparatus for securing at least one contact in a contact housing, consists of a contact-securing plate which is arranged such that it can be displaced perpendicularly with respect to the plug-in direction and interacts with carry-along elements of an attachment aid, which is displaced from a first position into a second position by virtue of the rotary movement of a lever arm and, as a result, the contact-securing plate is displaced from a first unlatched position into a second latched position, and secures the contacts, even when the attachment aid is displaced from the second position back into the first position.

10 Claims, 1 Drawing Sheet

APPARATUS FOR SECURING CONTACTS IN A CONTACT HOUSING

BACKGROUND OF THE INVENTION

1. Field of the Invention

The invention relates to the general field of securing contacts in a contact housing.

2. Description of the Prior Art

An electric connector comprises a multi-part contact housing with a multiplicity of differently sized contacts in appropriately matching contact-receiving chambers. A contact-securing plate is arranged in the contact housing such that it can be displaced from a first position into a second position. If the contacts have not been inserted completely and correctly into the receiving chambers, it is not possible for the contact-securing plate to be displaced from the first position into the second position. It is only possible for the cover to be fitted onto the contact housing if the contact-securing plate is located in the second position. The mating housing can be plugged on irrespective of the position of the contact-securing plate. An apparatus of this generic type of the invention is known from EP 655 799 A1 (incorporated herein by reference).

SUMMARY OF THE INVENTION

The object of the invention is to specify an apparatus which is intended for securing contacts in a contact housing and which ensures that, in the plugged-in state, the contacts are secured in each case.

This object is achieved by an apparatus which is intended for securing at least one contact in a contact housing provided for this purpose, the contact housing having a contact-receiving chambers for receiving contacts; in order to secure the contacts, a contact-securing plate is arranged in the contact housing and is displaceable, perpendicularly with respect to the plug-in direction, from a first position, in which the contacts can be introduced into the contact housing, into a second position, in which the contacts are secured in the contact housing; in order for a mating housing to be plugged on, an attachment aid is arranged on the contact housing such that the attachment aid can be displaced, perpendicularly with respect to the plug-in direction, from a first position into a second position; the attachment aid has at least one carry-along element, which interacts with the contact-securing plate in the contact housing; by virtue of the movement of the attachment aid, with the carry-along element, from the first position into the second position, the contact-securing plate is displaced from the first position into the second position; when the attachment aid moves, with the carry-along element, from the second position into the first position, the contact-securing plate remains in the second position.

It is advantageous that the apparatus ensures that, once the contacts have initially been introduced into the contact housing and secured therein, said contacts are secured in all subsequent operating steps unless the contact-securing plate is deliberately and intentionally moved from the second position into the first position because once the contact securing plate has initially moved from the first position into the second position, the contact-securing plate is latched in and remains in the second position, and is not carried along again by the carry-along element in the event of a subsequent movement of an attachment aid from the second position into the first position. It is also advantageous that the attachment aid cooperates with the contact securing plate such that interference occurs unless the plate is in the second position.

DETAILED DESCRIPTION OF THE PREFERRED EMBODIMENT

Figure 1:
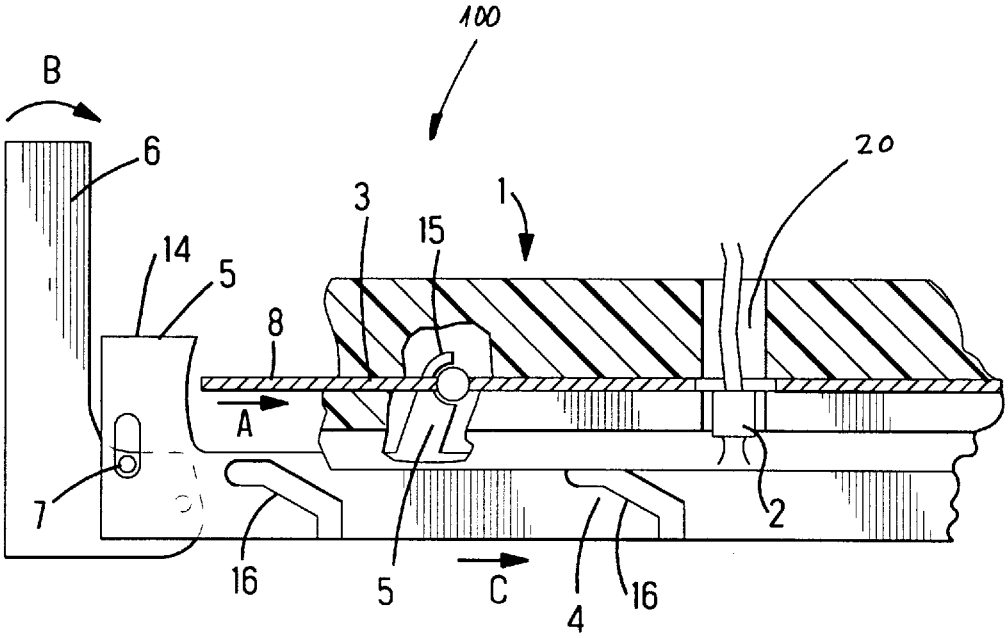
FIG. 1 shows a view, partially in section, of the preferred exemplary embodiment in a first position.
Figure 2:
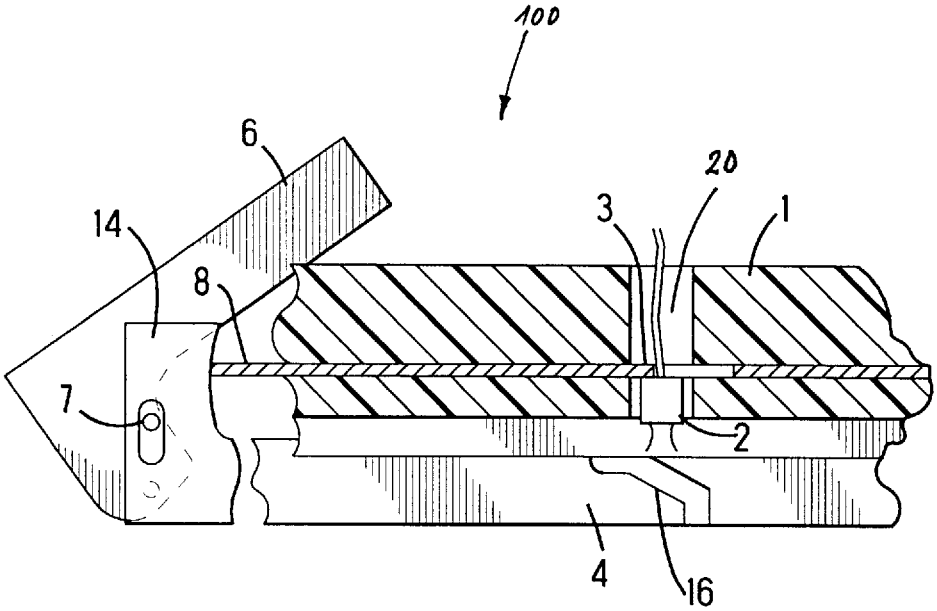
FIG. 2 shows a view, partially in section, of the apparatus of FIG. 1 in a second position.

FIGS. 1 and 2 are schematically illustrated views of part of a multi-pole connector 100. A contact housing 1 receives a contact 2 in a contact-receiving chamber 20 provided for this purpose. A contact-securing plate 3 is arranged in the contact housing 1 so that it can be displaced perpendicularly with respect to the plug-in direction of contact 2. The direction of displacement is indicated by the arrow A. In FIG. 1, the contact-securing plate 3 is located in a first position, in which the contacts 2 can be introduced in the contact-receiving chamber 20 of the contact housing 1, but are not secured therein.

FIG. 2 illustrates the apparatus of FIG. 1 in a second position. The contact-securing plate 3 is located in the second position, in which the contacts 2 are secured in the contact-receiving chamber 20 of the contact housing 1. An attachment aid 4 is arranged on the contact housing 1 such that the attachment aid 4 too can be displaced from a first position into a second position. The direction of movement of the attachment aid 4 is indicated by an arrow C in FIG. 1. When viewed in the plug-in direction, the attachment aid 4 is located, on the contact housing 1, on the side of the mating housing (not illustrated here). The attachment aid 4 has at least one carry-along element 5, which interacts with the contact-securing plate 3 in the contact housing 1.

The mechanism which couples the movement of the attachment aid 4 to the movement of the contact-securing plate 3 from the first position into the second position may comprise a finger part 15 on the attachment aid 4 which would extend through a clearance of the contact-securing plate 3. This structure may be configured to interact with the contact-securing plate 3 either inside or outside the contact housing 1. As can be observed, the carry-along element 5 of the attachment aid 4 initiates displacement of the contact-securing plate 3 in only one direction, that is to say by pushing in the direction from the first position to the second position of the contact-securing plate 3. In the reverse direction, from the second position to the first position, however, the carry-along element 5 does not displace the contact-securing plate 3.

A further mechanism for displacing along the contact-securing plate 3 is also illustrated. The contact-securing plate 3 has an extension 8 positioned laterally outside the contact housing 1. An L-shaped part 14 of the attachment aid 4, this part 14 will interact with the extension 8 of the contact-securing plate 3. When the mating housing is plugged onto the contact housing 1, the attachment aid 4 ensures that the two housing halves are plugged together securely. For this purpose, the attachment aid 4 has camming surfaces 16, which interact with protrusions on the mating housing (not illustrated here). The configuration of the camming surfaces 16 on the attachment aid 4 and the extension 8 of the contact-securing plate 3 ensure that, when the mating housing is attached to the contact housing 1, the contacts 2 are secured by the contact-securing plate 3 before the mating contacts of the mating housing touch the contacts 1.

A lever arm 6 is arranged rotatably on the contact housing 1. The lever arm 6 has at least one eccentric protrusion 7, which interacts with the attachment aid 4. The direction of movement of the lever arm 6 is indicated by an arrow B in FIG. 1. The lever arm 6 is used, in particular, so that the plug-in forces which may occur in multi-pole connectors are kept low.

FIG. 1 illustrates the lever arm 6 in the first position. In this position, the contacts 2 may be inserted into the contact-receiving chambers 20 without being secured by the contact-securing plate 3. In this position, there is still no connection between the contact housing 1 and the mating housing. FIG. 2 illustrates the lever arm 6 in the second position. In this position, the inserted contacts 2 are secured in the contact-receiving chambers 20 by the contact-securing plate 3. By pivoting the lever arm 6 over, it is possible to produce the connection between the contact housing 1 and the mating housing.

By virtue of the movement of the lever arm 6 from the first position into the second position, the attachment aid 4 is moved, via the eccentric protrusion 7, from the first position into the second position and, as a result, the contact-securing plate 3 is pushed from the first position into the second position. This movement may also be carried out without the mating housing being plugged on. This means that it is possible for the contacts already to be secured in pre-assembly before ultimate use. Since the carry-along elements 5 interact with the contact-securing plate 3 in only one direction, the contacts 2 remain secured even when the attachment aid 4 and the lever arm 6 are moved from the second position back into the first position.

The first and the second positions of the contact-securing plate 3 are defined by latching means on the contact housing 1, these means interacting with complementary latching means on the contact-securing plate 3. It is also possible for the attachment aid 4 and lever arm 6 to be arranged in a latchable manner in the first and the second positions. By virtue of the extension 8, which is located laterally outside the contact housing 1, the contact-securing plate 3 can be moved from the first position into the second position, and from the second position into the first position, if necessary even without the lever arm 6 being actuated. Since the release of the contacts 2 from the secured apparatus in the contact housing 1 is required less frequently, coupling of the movement of the contact-securing plate 3 to the movement of the attachment aid 4 and of the lever arm 6 in the direction from the second position to the first position is neither necessary nor expedient. The interaction of the attachment aid 4 with the contact-securing plate 3 in the movement from the first position into the second position ensures in each case that the contacts 2 are secured when the contact housing 1 is plugged to the mating housing.

The apparatus for securing contacts 2 is used in single-pole or multi-pole socket housings or pin housings. Once the contacts 2 have been inserted completely into the contact housing 1, the contacts 2 are secured by the movement of the contact-securing plate 3. The contact housing 1 is packed, and delivered to the end user, in the ready-to-use state.

The next operating step is normally that of plugging the mating housing and the contact housing 1 together. In order for the mating housing to be plugged on, it is necessary for the lever arm 6 to be opened and for the mating housing to be inserted into the attachment aid 4. Thereafter, the lever arm 6 is pivoted over again from the first position into the second position, the attachment aid 4 is displaced from the first position into the second position, and the mating housing is connected to the contact housing 1. The contacts 2 in the contact housing 1 are not in any case released again from the secured apparatus by the opening of the lever arm 6 and the displacement of the attachment aid 4.

We claim:

1. An electrical connector comprising:

a contact housing having contact-receiving chambers for receiving contacts;

a contact-securing plate for securing the contacts is arranged in the contact housing such that it can be displaced perpendicularly with respect to a plug-in direction of the contacts, from a first position, in which the contacts can be introduced into the contact housing, into a second position, in which the contacts are secured in the contact housing;

an attachment aid is arranged on the contact housing such that it can be displaced perpendicularly with respect to the plug-in direction, from a first position into a second position in order for a mating housing to be plugged on; the attachment aid has at least one carry-along element, which interacts with the contact-securing plate in the contact housing; whereby movement of the attachment aid, with the carry-along element thereupon, from the first position into the second position, displaces the contact-securing plate from the first position to the second position; and in that, when the attachment aid moves, with the carry-along element, from the second position into the first position, the contact-securing plate remains in the second position.

2. The electrical connector according to claim 1 wherein the carry-along elements cooperate with the securing plate along the length thereof.

3. The electrical connector according to claim 1 wherein the carry-along elements cooperate with the securing plate at the end thereof.

4. The electrical connector according to claim 1 wherein the carry-along elements cooperate with the securing plate both along the length and at an end thereof.

5. The electrical connector according to claim 1 wherein the attachment aid includes camming slots for cooperating with keys of a mating connector.

6. An electrical connector comprising:

a contact housing having contact-receiving chambers for receiving contacts;

a contact-securing plate is arranged in the contact housing in order to secure the contacts and is displaceable, perpendicularly with respect to the plug-in direction of the contacts from a first position, in which the contacts can be introduced into the contact housing, into a second position, in which the contacts are secured in the contact housing;

an attachment aid is arranged on the contact housing such that it can be displaced, perpendicularly with respect to the plug-in direction, from a first position into a second position in order for a mating housing to be plugged on;

a rotatable lever arm on the contact housing is connected to the attachment aid such that, by virtue of the movement of the lever arm from a first position into a second position, the attachment aid is displaced, perpendicularly with respect to the plug-in direction, from the first position into the second position;

the attachment aid has at least one carry-along element that interacts with the contact-securing plate in the contact housing; where, by virtue of the rotary movement of the lever arm from the first position into the second position, the contact-securing plate and the attachment aid, with the carry-along element, are displaced from the first position into the second position; and rotary movement of the lever arm from the second position into the first position, the attachment aid is displaced from the second position into the first position while the securing plate remains in the position retaining the contacts.

7. The electrical connector according to claim 6 wherein the carry-along elements cooperate with the securing plate along the length thereof.

8. The electrical connector according to claim 6 wherein the carry-along elements cooperate with the securing plate at the end thereof.

9. The electrical connector according to claim 6 wherein the carry-along elements cooperate with the securing plate both along the length and at an end thereof.

10. The electrical connector according to claim 6 wherein the attachment aid includes camming slots for cooperating with keys of a mating connector.

* * * * *